US007379680B2

(12) United States Patent
Calamita

(10) Patent No.: US 7,379,680 B2
(45) Date of Patent: May 27, 2008

(54) SYSTEMS AND METHODS FOR DETERMINING FEED FORWARD CORRECTION PROFILE FOR MECHANICAL DISTURBANCES IN IMAGE FORMING DEVICES

(75) Inventor: James P. Calamita, Spencerport, NY (US)

(73) Assignee: Xerox Corporation, Norwalk, CT (US)

( * ) Notice: Subject to any disclaimer, the term of this patent is extended or adjusted under 35 U.S.C. 154(b) by 341 days.

(21) Appl. No.: 11/125,103

(22) Filed: May 10, 2005

(65) Prior Publication Data

US 2006/0257158 A1 Nov. 16, 2006

(51) Int. Cl.
*G03G 15/00* (2006.01)

(52) U.S. Cl. ..... 399/36; 399/167

(58) Field of Classification Search ..... 399/36, 399/167

See application file for complete search history.

(56) References Cited

U.S. PATENT DOCUMENTS

2006/0244404 A1 11/2006 Carolan

FOREIGN PATENT DOCUMENTS

JP 11258921 A * 9/1999

* cited by examiner

*Primary Examiner*—David M. Gray
*Assistant Examiner*—Ryan D. Walsh
(74) *Attorney, Agent, or Firm*—Oliff & Berridge, PLC

(57) ABSTRACT

A capability is provided to reduce misregistration effects, and/or color-to-color registration errors, in output multi-color images based on velocity and position deviations and/or disturbances in transfer subsystems in image forming devices. A capability is provided to automatically compensate for torque disturbances caused by a photoreceptor belt seam crossing a mechanical device in a photoreceptor belt-based transfer subsystem in an image forming device. A learning algorithm, based on a mathematical model of transfer subsystem mechanical operational dynamics by which a series of performance curves could be generated, is employed to facilitate prediction of a torque disturbance profile in a mechanical motor driven transfer subsystem in an image forming device in order to produce a response profile which automatically predictively attempts to nullify the effects of the mechanical torque disturbance.

21 Claims, 4 Drawing Sheets

SYSTEMS AND METHODS FOR DETERMINING FEED FORWARD CORRECTION PROFILE FOR MECHANICAL DISTURBANCES IN IMAGE FORMING DEVICES

BACKGROUND

This disclosure is directed to systems and methods for incorporating a learning algorithm for adaptive feed forward control to assist in automatically rejecting repetitive torque disturbances for mechanically moving parts in image forming devices.

A variety of systems of methods are conventionally used to perform electrophotographic and/or xerographic image production and/or reproduction in image forming devices. One common system includes a transfer subsystem that further includes an electrophotographic photoreceptor belt.

FIGS. 1 and 2 illustrate a side elevation view and a front elevation view, respectively, of a schematic of a transfer subsystem 100, which includes a photoreceptor belt 110. A photoreceptor belt motor drive unit 122 engages the photoreceptor belt 110 and moves the photoreceptor belt 110 across a series of support rollers 124, 130, 132, 134, 142, 144, 146, and/or a plurality of non-rotating support bars 152, 154, 156, 158.

Typically, photoreceptor belts are fabricated from long sheets of photoreceptor material that are cut to size. The ends of the cut photoreceptor material are welded, or otherwise mated, together in order to form a continuous belt. This fabrication process produces a photoreceptor belt seam 115 at the point where the ends of the photoreceptor belt 110 are welded, or otherwise mated, together.

Some transfer subsystems, such as the one shown in FIGS. 1 and 2, include an acoustic transfer assist (ATA) module 120, which draws the photoreceptor belt 110 into a plenum using a vacuum. The ATA module 120 vibrates the photoreceptor belt 110 in the plenum to aid in transferring toner from the photoreceptor belt 110 to an image receiving medium.

In areas of the photoreceptor belt 110 where there is no seam, a tight vacuum is maintained in the ATA module 120. However, when the photoreceptor belt seam 115 of the photoreceptor belt 110 crosses the ATA module 120, the vacuum seal is momentarily broken. Drag of the photoreceptor belt 110 on the photoreceptor belt motor drive unit 122 momentarily reduces causing the photoreceptor belt motor drive unit 122 to speed up. Speed of the photoreceptor belt motor drive unit 122 must be tightly controlled for reasons that will be discussed in greater detail below. Photoreceptor belt velocity sensors (not shown) sense the increase in velocity of the photoreceptor belt motor drive unit 122. A motor control device reacts to readjust the speed of the photoreceptor belt motor drive unit 122 and the photoreceptor belt 110.

Even a momentary perturbation in photoreceptor belt velocity during imaging affects imaging results by, for example, producing defects in output hard-copy images transferred to an image receiving medium. Color photoreceptor belt-based systems include a plurality of imaging stations, each for a different one of a plurality of primary colors. An output multi-color spectral image is produced when toner particles of one or more of the primary colors are attracted to a respective one of a plurality of identical transfer images electrostatically formed in a plurality of discrete positions for each single primary color on the photoreceptor belt 110. As the photoreceptor belt 110 passes over the image receiving medium, toner is transferred one color at a time to the image receiving medium. Each of the primary colors of toner particles mix with any previously laid down on the image receiving medium in an image-on-image transfer process. A single pass of a plurality of transfer images, each laden with a single primary color on the photoreceptor belt, forms the mix of colors necessary to produce and/or reproduce the output color image on the image receiving medium.

Precise control of the velocity and the position of the photoreceptor belt 110 is necessary in order to attempt to ensure that each of the plurality of separate single color images is precisely overlaid on the image receiving medium in order to produce the output color image. When individual single color images do not correctly align, based mechanical transients and/or disturbances in the transfer subsystems such as, for example, velocity and/or position mismatches, or transient errors in control of the photoreceptor belt 110, image quality will decrease because the colors do not precisely line up. Such defects in output hard-copy images in electrophotographic and/or xerographic image forming devices are referred to alternatively as misregistration of colors or color-to-color registration errors. Such misregistration of colors may initially fall below any detectable threshold, but increases, i.e., becomes more pronounced and/or noticeable, as image-on-image systems and/or system components age or wear under use.

SUMMARY

The mechanical operating dynamics of a transfer subsystem, and/or photoreceptor belt module, can be modeled mathematically. Parametric studies have been undertaken in an analysis space using mathematical models, and mechanical transients, such as those related to photoreceptor belt velocity, which may occur from any number of sources including, for example, a photoreceptor belt seam passing over an ATA module, are recorded.

New U.S. Patent Application entitled "Systems and Methods for Reducing Torque Disturbance in Devices Having an Endless Belt" by Kevin M. Carolan, filed on May 5, 2005 under Xerox Ser. No. 11/118,488, which is commonly assigned and the disclosure of which is incorporated herein in its entirety by reference, teaches a control system to compensate for motion disturbances which may cause defects in multi-color output images produced by image forming devices, particularly those image forming devices which include transfer subsystems centered around a photoreceptor belt transfer device. The disclosed system may include a controller that determines when a torque disturbance is expected to occur and controls the photoreceptor belt motor drive unit with a compensation amount that may be retrieved from a data structure, such as, a pre-stored lookup table or a mathematical algorithm that is not specifically defined. This compensation amount from the data structure may be adjusted via a gain factor and may be combined with the output of a closed loop compensator at a summation point. The output has the form of a predetermined curve of a specific shape, and with a specific timing of a repetitive torque disturbance, to attempt to minimize the misregistration effect produced by the torque disturbance in the output images produced by the image forming device. Ser. No. 11/118,488 employs a timing methodology to anticipate the onset of a disturbance and via the controller attempts to insert an opposing profile that causes the photoreceptor belt motor drive unit to generate an opposing torque to substantially nullify the disturbance. Amplitude of a correction profile, corresponding to the amplitude of the disturbance, is manually adjusted to attempt to minimize the effects of the disturbance on the produced output images, for example, the color-to-color registration error. The controller monitors the onset of the disturbance or predicts the onset of the disturbance based on sensed photoreceptor belt position and encoder timing. Actuator parameters are adjusted based on preadjusted manually input correction factors to attempt to minimize the effects of the disturbance. Correction factors for the current operating state of the transfer subsystem in the image forming device are obtained substantially through a trial and error method.

It would be advantageous if, instead of requiring manual input and/or adjustment of the feed forward correction factors to an FFC device, a system or method could be provided to automate and/or adapt an FFC profile to match precisely the timing and nature of a torque disturbance in a transfer subsystem. Such a system or method may reduce or substantially nullify torque disturbances, such as, for example, torque disturbances caused by a photoreceptor belt seam passing over an ATA in a photoreceptor belt-based transfer subsystem in an electrophotographic and/or xerographic image forming device.

Exemplary embodiments of disclosed systems and methods may provide a leaning algorithm using a correlated model of system dynamics to compensate for torque disturbances in mechanical systems, such as, for example, transfer subsystems, in image forming devices.

Exemplary embodiments of disclosed systems and methods may employ a learning algorithm, based on a mathematical model of transfer subsystem mechanical operational dynamics by which a series of performance curves could be generated. The learning algorithm may allow prediction of a torque disturbance profile in a mechanical motor driven transfer subsystem in an image forming device in order to produce a response profile which predictively attempts to nullify the effects of the mechanical torque disturbance.

Exemplary embodiments of disclosed systems and methods may provide a learning algorithm which can be used to determine a width, start position and height of a correction factor, based on sensed maximum and minimum disturbed velocities in the photoreceptor belt motor drive unit, and the positions at which these velocities occur in a belt movement cycle referenced to a belt position reference point. These correction factors are provided as inputs to, and/or through, an FFC device to predictively correct motor velocity for a pending torque disturbance which may be, for example, caused by a photoreceptor belt seam crossing an ATA.

Exemplary embodiments of disclosed systems and methods may provide a capability to reduce misregistration effects, and/or color-to-color registration errors, in output images based on velocity and position deviations and/or disturbances in photoreceptor belt-based transfer subsystems in image forming devices.

These and other features and advantages of the disclosed embodiments are described in, or apparent from, the following detailed description of various exemplary embodiments of the systems and methods.

BRIEF DESCRIPTION OF THE DRAWINGS

Various exemplary embodiments of disclosed systems and methods will be described, in detail, with reference to the following figures, wherein.

DETAILED DESCRIPTION OF EMBODIMENTS

Figure 1:
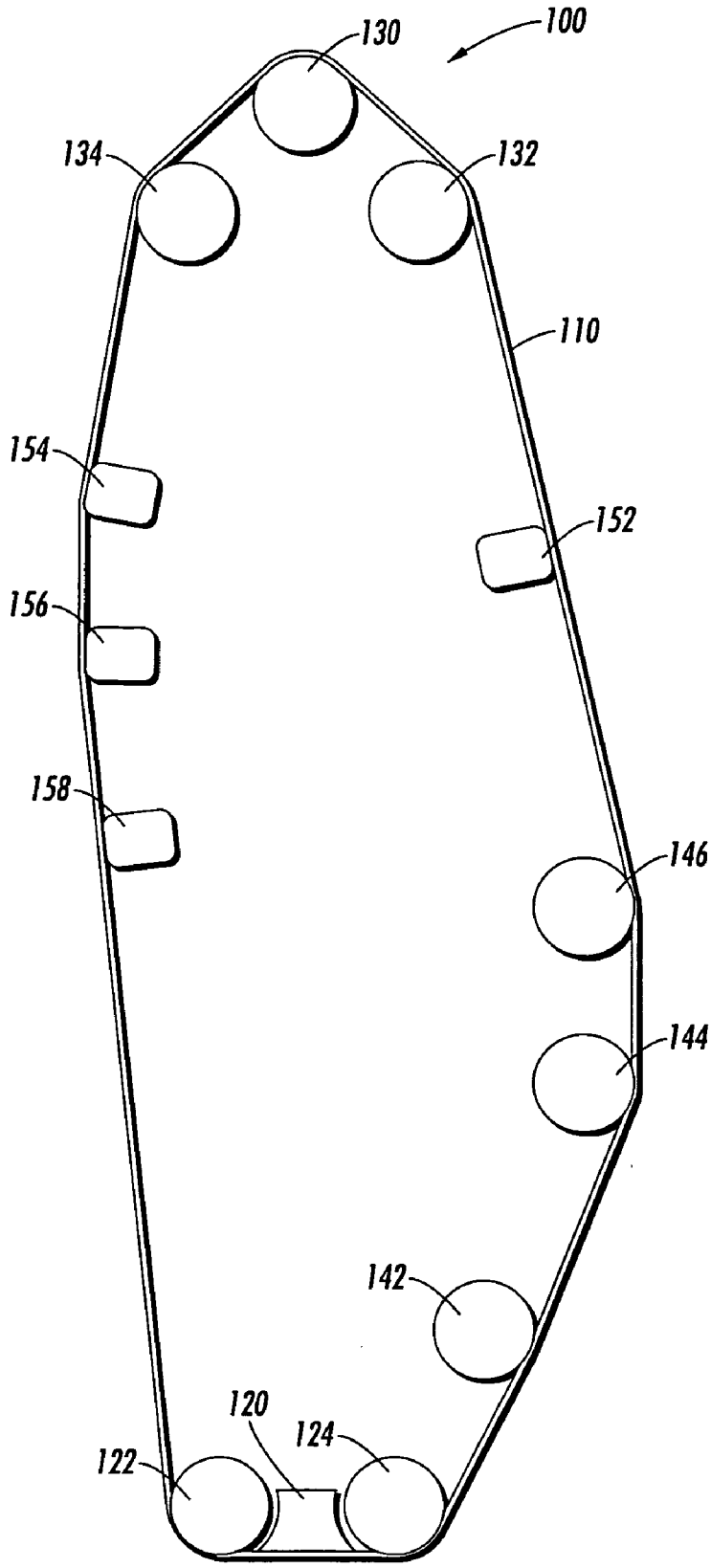
FIG. 1 illustrates a schematic side elevation view of a transfer subsystem for an image forming device including a seamed photoreceptor belt.
Figure 2:
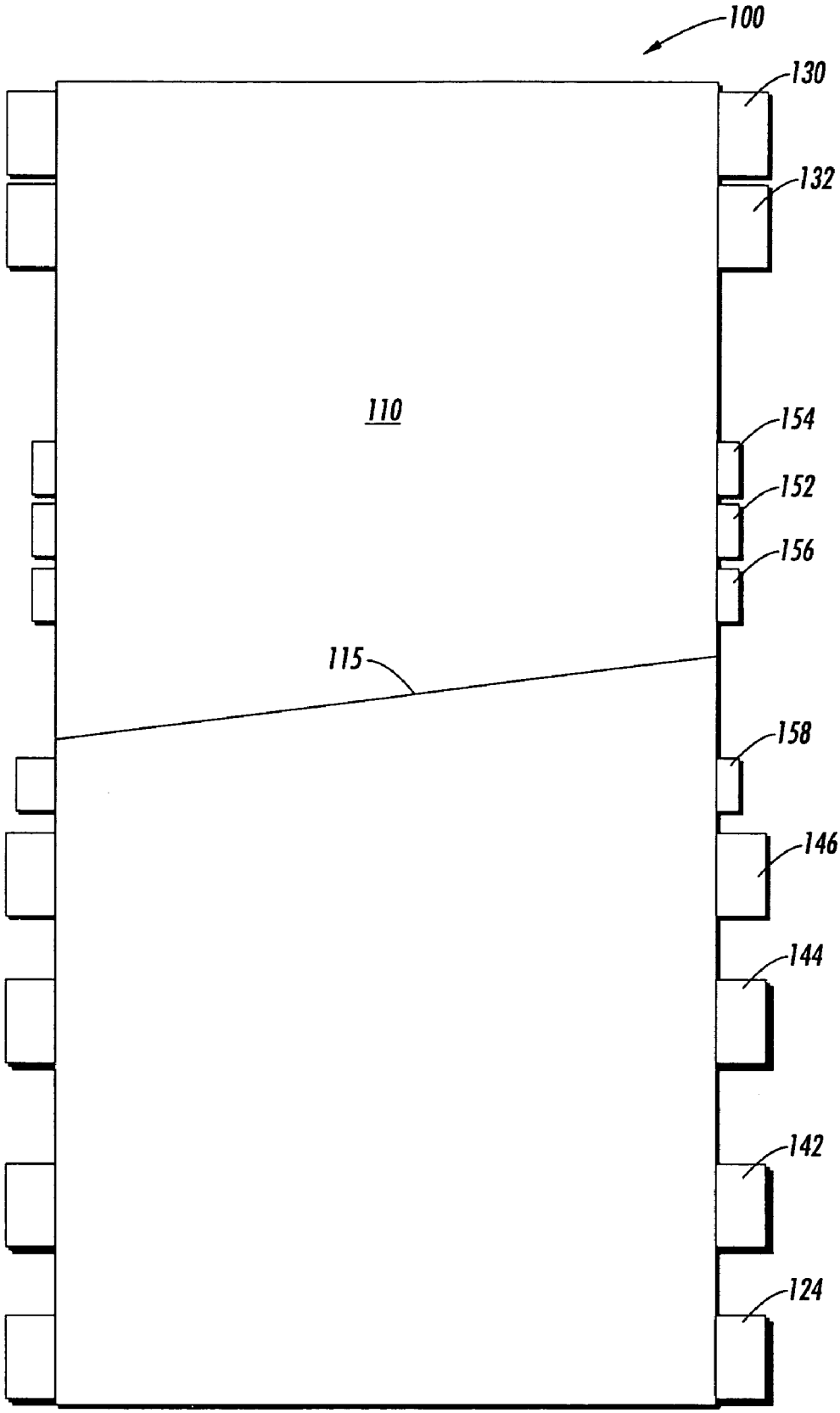
FIG. 2 illustrates a schematic front elevation view of a transfer subsystem for an image forming device including a seamed photoreceptor belt.

The following description of various exemplary embodiments of automated and/or adaptive feed forward control systems and methods for predictively adjusting a mechanical velocity of a transfer subsystem to compensate for mechanical torque disturbances in the transfer subsystem in an image forming devices may refer to and/or illustrate one specific type of transfer subsystem, a seamed photoreceptor belt-based transfer subsystem, for the sake of clarity, familiarity, and ease of depiction and description. However, it should be appreciated that the principles disclosed herein, as outlined and/or discussed below, can be equally applied to any known, or later-developed, system in which, based on some measurable mechanical disturbance which may corrupt constant speed and related positioning of a repetitive mechanical input, the mechanical disturbance can be controlled, and the effects of such disturbance reduced and/or nullified.

Various exemplary embodiments of disclosed systems and methods may automate a capability to reduce, and/or substantially eliminate, out-of-specification color-to-color registration errors in output hard copy images produced by, or reproduced in, electrophotographic and/or xerographic image production and/or reproduction devices.

A general location regarding where in the mechanical cycle of the transfer subsystem of the transient is going to occur is known. Based on this knowledge, a manual feed forward control method has previously been implemented. This manual feed forward control method has been shown to be effective in reducing transients such as those caused by torque disturbances. This objective is accomplished by providing manual inputs to a feed forward control (FFC) device to command a photoreceptor belt motor drive unit through a profile that counteracts the transient just as, or slightly before, the transient occurs.

A learning algorithm, according to the systems and methods disclosed herein, is intended to automate, and thereby make more efficient, determination of the timing and the size of the feed forward correction profile. This disclosure responds to a need to provide a system and method for automating and adapting FFC profile generation in individual image forming devices.

Various exemplary embodiments of disclosed systems and methods may allow simple information to be measured from actual transients experienced by the mechanical transfer subsystem in operation. Specifically, the measured parameters may include maximum belt velocity experienced during a disturbance and minimum belt velocity experienced during a disturbance. With these parameters, referenced to a belt position at which each occurs, the nature of the disturbance may be characterized. A responsive set of correction factors may then be precalculated. These correction factors, characterizing a correction profile, may then be input to, or through, an FFC device to control the velocity of, for example, a photoreceptor belt motor drive unit as a repetitive torque disturbance, e.g., a seam crossing an acoustic transfer assist (ATA) unit, approaches. The FFC device maintains substantially constant speed of the mechanical system, for example, the photoreceptor belt, through the transient torque period.

Various exemplary embodiments of disclosed systems and methods may compute a start point, height and width of a disturbance in order to obtain correction factors representing a correction profile for current operating conditions of an image forming device. Such a correction profile may be obtained at regular intervals, or on an as-needed cycle, in order that feed forward control can be implemented through an FFC device such that torque disturbances in such image forming devices are minimized.

Figure 3:
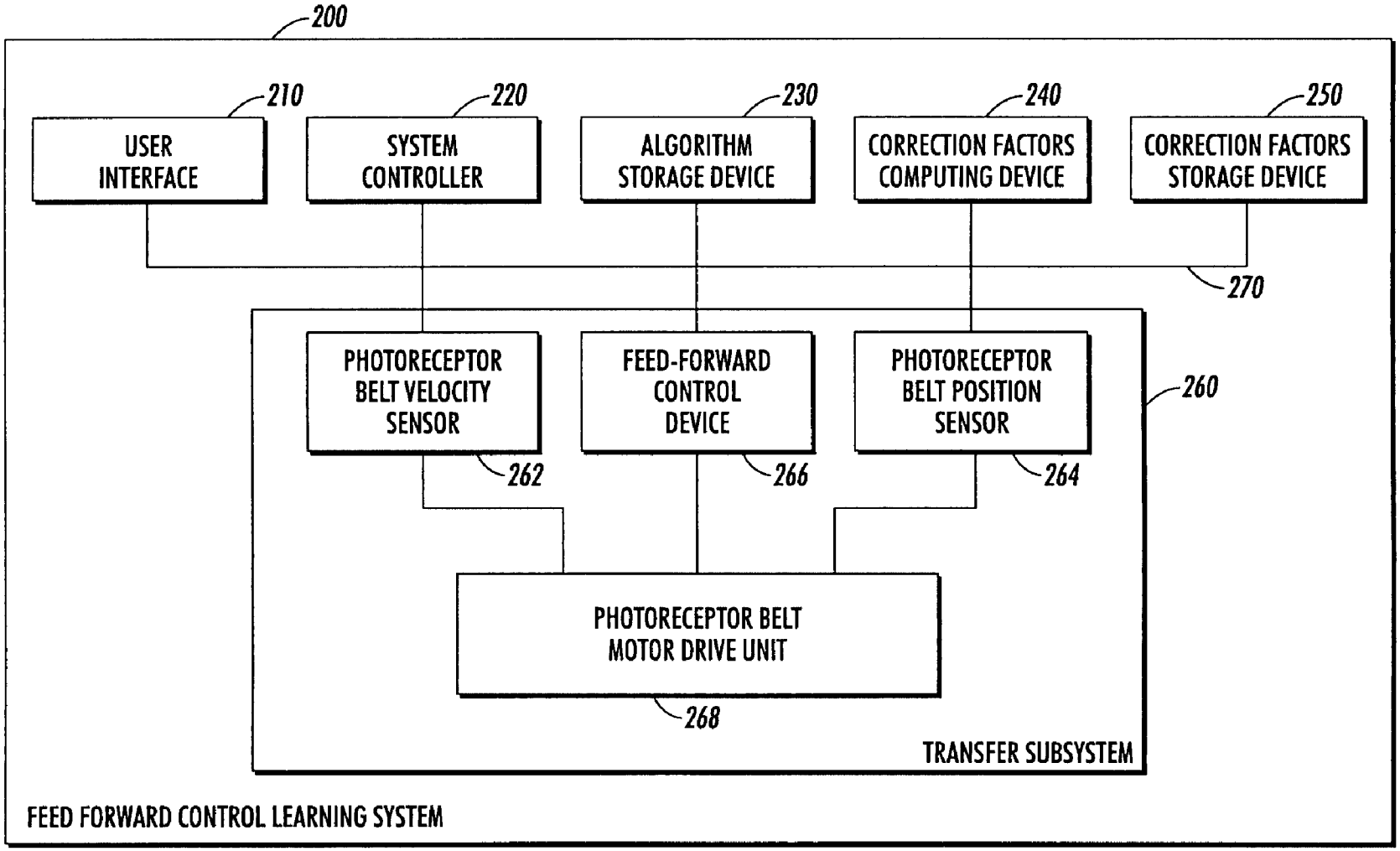
FIG. 3 is a schematic block diagram of an exemplary system for implementing a learning algorithm for producing feed forward correction factors and implementing feed forward control of a mechanical operating system within the transfer subsystem of an image forming device.

FIG. 3 is a schematic block diagram of an exemplary system 200 for implementing a learning algorithm for producing feed forward correction factors and implementing feed forward control of a mechanical operating system within the transfer subsystem of an image forming device. As shown in FIG. 3, the system 200 may include a user interface 210, a system controller 220, an algorithm storage device 230, a correction factors computation device 240, and a correction factors storage device 250, which are interconnected, as appropriate, by a data/control bus 270. The system 200 also may include a transfer subsystem 260. The transfer subsystem 260 may further include a photoreceptor belt motor drive unit 268, a photoreceptor belt velocity sensor 262, a photoreceptor belt position sensor 264, and a feed forward control (FFC) device 266. The photoreceptor belt velocity sensor 262, photoreceptor belt position sensor 264, and FFC device 266 receive individual inputs from, or send individual control inputs to, the photoreceptor belt motor drive unit 268. These sensors 262, 264 and the FFC device 266 are also interconnected with the data/control bus 270 in order to provide information to, or receive information from, other system elements.

In various exemplary embodiments, as part of a warm-up cycle, or other pre-print cycling of the image forming device, the photoreceptor belt motor drive unit 268 is started. The FFC device 266 is not activated at that point and, as such, no correction factor is input to the photoreceptor belt motor drive unit 268. Reference is made to photoreceptor belt position by employing a photoreceptor belt position sensor 264. Photoreceptor belt position may be detected by, for example, detecting a hole or mark in the photoreceptor belt by the photoreceptor belt position sensor 264. The photoreceptor belt position sensor 264 may comprise an optical sensor, magnetic sensor, mechanical sensor, or any other suitable sensor.

A plurality of belt cycles may be undertaken as part of a warm-up cycle for the image forming device. On each cycle, the photoreceptor belt velocity is measured by a photoreceptor belt velocity sensor 262. The photoreceptor belt velocity sensor 262 may be an optical sensor, magnetic sensor, mechanical sensor, or any other suitable sensor. The photoreceptor belt velocity sensor 262 may be implemented by the photoreceptor belt position sensor 264 and a timing device by, for example, timing the interval between detection events completed by the photoreceptor belt position sensor 264. Alternatively, for example, the photoreceptor belt velocity sensor 262 may detect velocity based on rotational speed of the photoreceptor belt motor drive unit 130 (FIG. 1) or any other rotating element contacted by the belt.

A rudimentary profile of photoreceptor belt velocity versus photoreceptor belt position is obtained based on inputs from the photoreceptor belt velocity sensor 262 and the photoreceptor belt position sensor 264. These inputs either individually, or in a correlated manner, are input to the correction factors computation device 240. The measurements of photoreceptor belt position and photoreceptor belt velocity are conventionally undertaken to enable the system to provide control of the speed of the photoreceptor belt motor drive unit 268 under varying operating conditions.

Maximum and minimum photoreceptor belt velocity values are measured and recorded on each of the plurality of photoreceptor belt cycles. These values are preferably measured over a series of non-printing cycles by the photoreceptor belt velocity sensor 262 and the photoreceptor belt position sensor 264, but may be measured over a series of printing cycles as well. The series of values for each of the maximum photoreceptor belt velocity and minimum photoreceptor belt velocity, correlated to the photoreceptor belt position where each occurred on each cycle, are fed to the correction factors computation device 240. Each of the series of maximum photoreceptor belt velocities, minimum photoreceptor belt velocities, and corresponding photoreceptor belt positions is averaged. The result is an average value for each of the maximum photoreceptor belt velocity, the minimum photoreceptor belt velocity, average photoreceptor belt position where each of the average maximum photoreceptor belt velocity and the average minimum photoreceptor belt velocity can be referred to occur for this particular set of operating conditions, and the current condition of the transfer subsystem.

With the computed average values for the above parameters, a set of feed forward correction factors can be determined. These include width of the correction factor, starting position of the correction factor, and height of the correction factor. The correction factors are related to the respective width, start point and height of the torque disturbance.

An example regarding calculation of a set of feed forward correction factors will now be undertaken employing a set of algorithms, the constant values (C1-C8) of which may be analytically derived for an exemplary image forming device. In order to determine width of ($W_d$) torque disturbance for the exemplary image forming device analytically, an analytical model of the imaging system is exercised for a range of torque disturbance widths. A plot of the positional difference between the maximum and minimum velocity points v. the disturbance pulse width yields a linear relationship whose best fit line was determined to satisfy the following equation:

$$W_D = C1*(P_{max} - P_{min}) + C2 \quad \text{(Equation 1)}$$

where:

$W_D$ is the width of the disturbance in seconds;

$P_{max}$ is the photoreceptor belt position of the maximum photoreceptor belt velocity (as averaged);

$P_{min}$ is the photoreceptor belt position of the minimum photoreceptor belt velocity (as averaged); and C1 is the analytically determined slope of the best fit line for the plot of (Pmax−Pmin) v. disturbance width; and C2 is the analytically determined Y-intercept of the best fit line for the plot of (Pmax−Pmin) v. disturbance width.

Photoreceptor belt position is measured referenced to a specific photoreceptor belt position indicator reference, for example, a photoreceptor belt reference hole.

$W_D$, in seconds, is then equal to $W_{FFC}$ or the width of the feed forward correction, in seconds.

In order to determine the start position of the feed forward correction factor, the system may employ the position of the point of maximum photoreceptor belt velocity ($P_{max}$), i.e., the distance of the point of maximum photoreceptor belt velocity from the photoreceptor belt hole sensor, and the width of the disturbance ($W_D$) as computed above. First, from the analytically derived equations such as those determined for the exemplary image forming device here, the system may solve for a positional offset according to the following equation:

$$P_{off}=(C3\times W_D)+C4 \quad \text{(Equation 2)}$$

where:

$P_{off}$ is a positional offset factor based on the width of the disturbance ($W_D$); and C3 and C4 are analytically determined constants based on exercising the model over a range of disturbance widths and start positions, and plotting the results in the form of $P_{max}$ vs $P_{DS}$ for different values of $W_D$.

The disturbance start point for this exemplary image forming device is then calculable based on the following equation:

$$P_{DS}=(C5\times P_{max})+P_{off} \quad \text{(Equation 3)}$$

where:

$P_{DS}$ indicates the position of the start of the disturbance, and the start position for inputting the feed forward correction factor ($P_{FFC}$); and C5 represents an additional analytically determined constant based exercising the model over a range of disturbance widths and start positions, and plotting the results in the form of $P_{max}$ vs $P_{DS}$ for different values of $W_D$, as above.

With the width of the disturbance ($W_D$), and therefore the width of the feed forward correction ($W_{FFC}$), in seconds, and the point at which the disturbance starts ($P_{DS}$) and therefore the position at which the feed forward correction needs to start ($P_{FFC}$) calculated, a third feed forward correction factor to be determined regards the height of the feed forward correction factor ($H_{FFC}$). This height will be based on the height of the disturbance. Analytically for the exemplary system, it was determined that contour lines for disturbances of differing heights for the exemplary image forming device all pass through a point C6 on the Y-axis of a standard X-Y plot. As such, a first component of the calculation may be to determine the slope (S) of a contour line on which a point ($V_{max}$-$V_{min}$, $W_D$) lies according to the following equation:

$$S=\frac{W_D-C6}{V_{\max}-V_{\min}} \quad \text{(Equation 4)}$$

With this slope (S) calculated, the height of the disturbance ($H_D$) may be determined according to the following equation:

$$H_D=\frac{S+C7}{C8} \quad \text{(Equation 5)}$$

where constants C6, C7 and C8 are derived analytically by plotting ($V_{max}$–$V_{min}$) v. $W_D$ for a range of disturbance heights, $H_D$.

Width of the disturbance ($W_D$) is equal to width of the feed forward correction factor ($W_{FFC}$) in seconds, and position of the disturbance start ($P_{DS}$) is equal to the position at which the feed forward correction should start ($P_{FFC}$). Height of the feed forward correction ($H_{FFC}$), on the other hand, may not correlate on a one to one basis with height of the disturbance ($H_D$). For example, $H_{FFC}$ was experimentally established for the exemplary image forming device to be determined according to the following equation:

$$H_{FFC}=\text{round}(10\times H_D) \quad \text{(Equation 6)}$$

Having determined the three factors that determine the nature of the feed forward correction profile ($W_{FFC}$, $P_{FFC}$, and $H_{FFC}$), a feed forward correction profile is now defined. The feed forward correction profile can be output from the correction factors computing device 240 to the FFC device 266. When image printing commences, the feed forward correction profile is in place via the FFC device 266 to automatically reduce misregistration effects and/or color-to-color registration errors due to torque transients. Registration errors on the order of approximately 60 microns may be reduced to registration errors on the order of, for example, less than 35 microns, which are typically viewed as being within acceptable registration deviation limits.

It should be appreciated that, given the inputs of maximum photoreceptor belt velocity and minimum photoreceptor belt velocity based on the disturbance, with associated photoreceptor belt positions at which these points occur, software algorithms, hardware and/or firmware circuits, or any combination of software, hardware and firmware control elements, may be used to implement the individual computational devices and data storage units in the exemplary system 200.

It should be further appreciated that the individual devices and/or units depicted in FIG. 3 as internal to the exemplary system 200 could be either discrete devices, units and/or capabilities internal to the system 200, or may be presented individually, or in combination, attached as separate devices and/or units connected by any path that facilitates data communication and coordination between such devices and/or units such as, for example, one or more of a wired, a wireless, and/or an optical digital data transmission connection. Though presented as discrete elements, it should be recognized that the capabilities represented by the discrete elements depicted in FIG. 3 may be integrated into a single software algorithm, hardware and/or firmware circuit, or otherwise in any combination of such components.

Any of the data storage units depicted, or alternately as described above, may be implemented using any appropriate combination of alterable, volatile or non-volatile memory, or non-alterable, or fixed, memory. The alterable memory, whether volatile or non-volatile, may be implemented using any one or more of static or dynamic RAM, a computer disk and compatible disk drive, a writable or re-writable optical disk and associated disk drive, a hard drive, a flash memory, a hardware circuit, a firmware circuit, or any other like memory medium and/or device. Similarly, the non-alterable, or fixed, memory may be implemented using any one or more of ROM, PROM, EPROM, EEPROM, an optical ROM disk, such as a CD-ROM or DVD-ROM disk with a compatible disk drive; or any other like memory storage medium and/or device.

Figure 4:
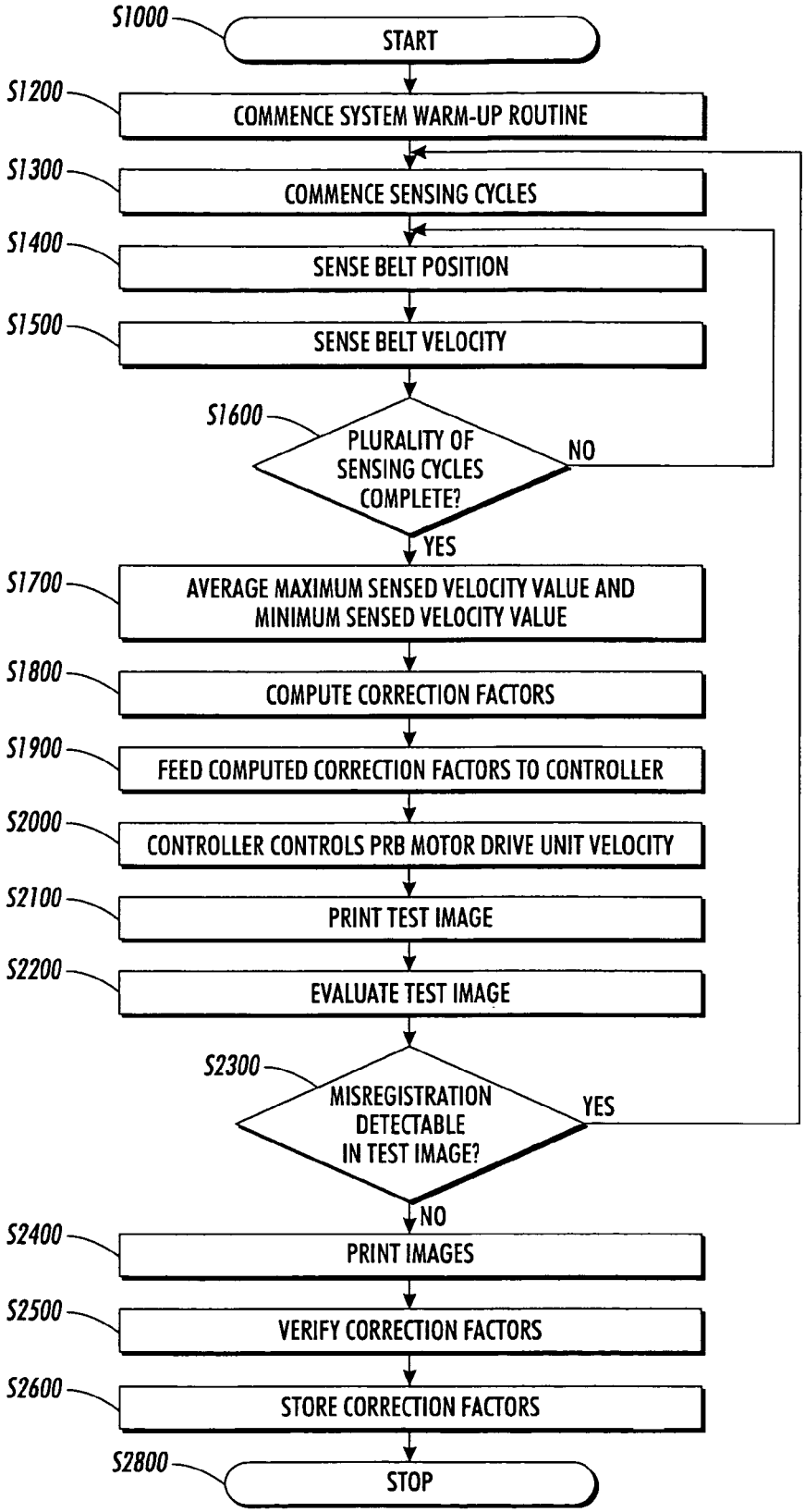
FIG. 4 is a flowchart outlining an exemplary method for implementing a learning algorithm to produce feed forward correction factors and to implement feed forward control of a mechanical operating system within the transfer subsystem of an image forming device.

FIG. 4 is a flowchart outlining one exemplary method for implementing a learning algorithm to produce feed forward correction factors and implement feed forward control of a mechanical operating system within the transfer subsystem of an exemplary image forming device.

As shown in FIG. 4, operation of the method begins at step S1000 and continues to step S1200 where the system warm-up routine of the image forming device commences. Operation of the method continues to step S1300.

In step S1300, a plurality of sensing cycles commence. Operation of the method continues to step S1400.

In step S1400, on each of the plurality of sensing cycles, photoreceptor belt position is sensed by a belt position sensor. Photoreceptor belt position is typically referenced to some standard photoreceptor belt position indicator such as, for example, a belt hole or mark. Operation of the method continues to step S1500.

In step S1500, photoreceptor belt velocity is measured as the photoreceptor belt travels through a full rotation, or a single cycle, of the plurality of sensing cycles. Photoreceptor belt velocity may be discretely or continuously referenced to photoreceptor belt position. Operation of the method continues to step S1600.

It should be appreciated that photoreceptor belt position and photoreceptor belt velocity are conventionally sensed in order to attempt to control speed of the photoreceptor belt motor drive unit within acceptable limits. Photoreceptor belt position is sensed with respect to a reference point. In the disclosed system, photoreceptor belt velocity is referenced to photoreceptor belt position through each cycle of the photoreceptor belt.

In step S1600, a determination is made whether the plurality of sensing cycles is complete. The number of sensing cycles for a given system may be manually or automatically input as part of the sensing routine, and may remain constant or may be variable based on other operating conditions.

If a determination is made in step S1600 that the required number of a plurality of sensing cycles is complete, the operation of the method continues to step S1700.

If a determination is made in step S1600 that the required number of a plurality of sensing cycles is not complete, the operation of the method returns to step S1400 and photoreceptor belt velocity and photoreceptor belt position continue to be sensed through the rest of a plurality of sensing cycles until the required number of sensing cycles is determined to be complete at step S1600.

In step S1700, average values of the maximum sensed photoreceptor belt velocities and the minimum sensed photoreceptor belt velocities are individually computed. Additionally, an average value for that photoreceptor belt position at which each of the averaged maximum photoreceptor belt velocity and the averaged minimum photoreceptor belt velocity values occurs through the plurality of cycles is also computed. Operation of the method continues to step S1800.

In step S1800, correction factors are computed according to a set of analytically derived equations for the specific image forming device that are then stored in the system. Such a set of equations was analytically derived for an exemplary image forming device and is listed in paragraphs [0034]-[0038] above. Operation of the method continues to step S1900.

In step S1900, the computed correction factors of height ($H_{FFC}$), width ($W_{FFC}$), and start position ($P_{FFC}$) for the feed forward corrections are fed to a feed forward control device. Operation of the method continues to step S2000.

In step S2000, the feed forward control device applies the computed correction factors in order to drive the photoreceptor belt motor drive unit velocity in such a manner to reduce the effect of repetitive torque disturbances thereon. Operation of the method continues directly to step S2400, or alternatively to optional step S2100.

In step S2100, the system is commanded to produce a test image on an image receiving medium. Operation of the method continues to step S2200.

In step S2200, a manual or automated evaluation of the test image is performed. Operation of the method continues to step S2300.

In step S2300, a determination is made as to whether misregistration of colors, or color-to-color registration error, is below registration threshold value in the test image.

If in step S2300 a color-to-color registration error is above registration threshold value, the system returns to step S1300 and another plurality of sensing cycles is undertaken.

If in step S2300 color-to-color registration is below the registration threshold value, the operation of the method continues to step S2400.

In step S2400, the requested series of multi-color output images commanded of the image forming device are printed. Operation of the method continues directly to step S2800, or alternatively to optional step S2500.

In step S2500, correction factors calculated for the transfer subsystem in the image forming device based on current operating conditions are verified. Operation of the method continues to step S2600.

In step S2600, verified correction factors may be stored in a data storage unit within the image forming device for future reference. Operation of the method continues to step S2800.

In step S2800, operation of the method stops.

It should be appreciated that, although the disclosed systems and methods have been described in conjunction with a conventional color image-on-image printing device, wherein a transfer subsystem is centered around a mechanically motor driven photoreceptor belt, the depictions and descriptions are illustrative and not meant to be in anyway limiting, particularly not limited to such a narrow application as any single color image printing device and/or any transfer subsystem that may be deemed to require a photoreceptor belt.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A method for correcting misregistration effects in an image forming device, comprising:

cycling a mechanical subsystem that may be subject to torque disturbances in operation through a plurality of cycles;

sensing velocity and position of the mechanical subsystem as the mechanical subsystem is cycled through the plurality of cycles;

measuring maximum and minimum velocities of the mechanical susbsystem in operation on each cycle;

associating maximum and minimum velocities for each cycle with a position of the mechanical subsystem at which each occurs;

averaging a single maximum velocity and a single minimum velocity value and a position at which each occurs for the plurality of cycles;

computing a set of feed forward correction factors based on a start point of a torque disturbance, a width of a torque disturbance, and a height of a torque disturbance obtainable from an algorithm that uses the averaged values for maximum velocity and minimum velocity and the associated positions of each as variables; and inputting the computed set of feed forward correction factors to a feed forward control device to automatically control the mechanical subsystem in anticipation of the torque disturbance in operation to reduce the effects of the torque disturbance.

2. The method of claim 1, wherein the cycles are non-printing cycles.

3. The method of claim 1, wherein the mechanical subsystem comprises a photoreceptor belt and an associated photoreceptor belt motor drive unit.

4. The method of claim 3, wherein the torque disturbances are associated at least with passage of a seam in the photoreceptor belt over at least one mechanical component in the mechanical subsystem.

5. The method of claim 4, wherein the at least one mechanical component is an acoustic transfer assist module.

6. The method of claim 1, wherein cycling the mechanical subsystem through the plurality of cycles occurs in the warm-up routine of the image forming device.

7. The method of claim 1, further comprising printing a test image and evaluating any misregistration effects in the test image prior to printing output multi-color images.

8. The method of claim 1, wherein misregistration effects are reduced by at least 15 microns.

9. The method of claim 1, wherein misregistration effects are reduced by at least 25 microns.

10. The method of claim 1, further comprising storing data associated with at least one of a computing algorithm, the measured values, or the computed feed forward correction factors.

11. A digital data storage medium on which is stored a program for implementing the method of claim 1.

12. A system for correcting misregistration effects in an image forming device, comprising:

a color image forming device, including a mechanical subsystem that may be subject to torque disturbances in operation, the mechanical subsystem further comprising:

a velocity sensor that senses velocity of the mechanical subsystem in operation;

a position sensor that senses mechanical subsystem position in operation; and a feed forward control device usable to adjust mechanical subsystem velocity in response to a torque disturbance;

a feed forward correction factor computing device that implements a learning algorithm to automatically compute a set of feed forward correction factors for input to the feed forward control device, the feed forward correction factors being computed based on sensed velocity and position of the mechanical subsystem, wherein the algorithm inputs are only an averaged single maximum velocity value and an averaged single minimum velocity value and a position at which each occurs for a plurality of cycles over which maximum and minimum velocities of the mechanical susbsystem in operation are measured and associated with a position of the mechanical subsystem at which each occurs.

the set of feed forward correction factors is based on a start point of a torque disturbance, a width of a torque disturbance, and a height of a torque disturbance obtainable from the algorithm using the averaged values for maximum velocity and minimum velocity and the associated positions of each as variables; and the set of feed forward correction factors define a feed forward correction profile which the feed forward control device implements to predictively adjust the velocity of the mechanical subsystem in anticipation of a repetitive torque disturbance.

13. The system of claim 12, wherein the mechanical subsystem comprises a photoreceptor belt and an associated photoreceptor belt motor drive unit.

14. The system of claim 13, wherein the torque disturbances are associated at least with passage of a seam in the photoreceptor belt over at least one mechanical component in the mechanical subsystem.

15. The system of claim 14, wherein the at least one mechanical component is an acoustic transfer assist module.

16. The system of claim 12, wherein the velocity and position measurements are undertaken over a plurality of non-printing cycles occurring in the warm-up routine of the image forming device.

17. The system of claim 12, further comprising a user interface, through which a user can manipulate the functioning of the system.

18. The system of claim 12, further comprising at least one digital data storage unit for storing at least one of learning algorithm data, sensed velocity and position data, or feed forward correction factor and profile data.

19. The system of claim 12, wherein the color image forming device comprises a color image printing device.

20. The system of claim 12, wherein the color image forming device comprises an image-on-image color image forming device.

21. The system of claim 12, wherein the color image forming device comprises a xerographic image producing device.

* * * * *